US011993444B2

(12) United States Patent
Comerford

(10) Patent No.: US 11,993,444 B2
(45) Date of Patent: May 28, 2024

(54) SHIPPING CONTAINER SYSTEMS

(71) Applicant: Brent Michael Comerford, Aliso Viejo, CA (US)

(72) Inventor: Brent Michael Comerford, Aliso Viejo, CA (US)

( * ) Notice: Subject to any disclaimer, the term of this patent is extended or adjusted under 35 U.S.C. 154(b) by 0 days.

(21) Appl. No.: 18/244,213

(22) Filed: Sep. 8, 2023

(65) Prior Publication Data

US 2024/0083654 A1 Mar. 14, 2024

Related U.S. Application Data

(60) Provisional application No. 63/404,897, filed on Sep. 8, 2022.

(51) Int. Cl.

| | |
|---|---|
| ***B65D 81/02*** | (2006.01) |
| ***B65D 5/20*** | (2006.01) |
| ***B65D 5/50*** | (2006.01) |
| ***B65D 5/64*** | (2006.01) |
| ***B65D 77/04*** | (2006.01) |
| ***B65D 81/05*** | (2006.01) |

(52) U.S. Cl.

CPC ..... *B65D 81/05* (2013.01); *B65D 5/2052* (2013.01); *B65D 5/5028* (2013.01); *B65D 5/64* (2013.01); *B65D 77/042* (2013.01)

(58) Field of Classification Search

CPC ..... B65D 5/2052; B65D 5/5028; B65D 5/64; B65D 77/042; B65D 81/05

USPC ..... 206/521, 583, 591, 592, 594

See application file for complete search history.

(56) References Cited

U.S. PATENT DOCUMENTS

| | | | | | |
|---|---|---|---|---|---|
| 3,279,677 | A * | 10/1966 | Wojcik | B65D 5/58 | 206/521 |
| 4,905,835 | A * | 3/1990 | Pivert | B65D 81/052 | 383/3 |
| 5,398,808 | A * | 3/1995 | Chen | B65D 5/5071 | 206/320 |
| 5,706,951 | A * | 1/1998 | Oinuma | H01L 21/67396 | 206/592 |
| 6,268,039 | B1 * | 7/2001 | Chou | B65D 5/5069 | 206/583 |

(Continued)

*Primary Examiner* — Luan K Bui

(74) *Attorney, Agent, or Firm* — Camuti Law Group, APC; Nathan Camuti

(57) ABSTRACT

There is disclosed a shipping container system comprising an outer container and a product compartment inside the outer container, wherein the product compartment comprises a product compartment base and a product compartment lid, wherein the product compartment base comprises a plurality of retention tabs maintaining a cushion gap between the product compartment and sidewalls of the outer container, a plurality of support tabs maintaining a cushion gap between the product compartment and a base of the outer container, and a pair of suspension units maintaining a cushion gap between the product compartment and each end of a pair of opposing ends of the outer container, and wherein the product compartment lid includes a plurality of space tabs maintaining a cushion gap between the product compartment and a lid of the outer container, wherein the cushion gaps are maintained between the product compartment and the outer container when the outer container is in a closed configuration.

7 Claims, 9 Drawing Sheets

(56) References Cited

U.S. PATENT DOCUMENTS

| | | | | |
|---|---|---|---|---|
| 7,278,249 | B2 * | 10/2007 | Kari | B65D 5/5052 493/137 |
| 2005/0115864 | A1 * | 6/2005 | Liverman | B65D 81/113 206/586 |
| 2006/0180497 | A1 * | 8/2006 | Ting | B65D 5/5085 206/592 |
| 2010/0187149 | A1 * | 7/2010 | Tsukii | B65D 5/5035 493/405 |
| 2023/0202730 | A1 * | 6/2023 | Comerford | B65D 81/07 206/521 |

* cited by examiner

SHIPPING CONTAINER SYSTEMS

BACKGROUND

Shipping products to consumers has become a vital part of our everyday lives. Shipping containers are typically designed to maximize efficiency in packing shipping vehicles. Frequently, a shipping container contains items that fill only a small portion of the volume of the container, requiring the space to be filled with other material, such as air-filled plastic pouches or shredded paper. Alternative solutions include affixing products to a piece of cardboard using plastic film of sorts and adding some pieces to cause the plastic wrapped board and product to remain positioned in the cavity of the box. Existing solutions are expensive and use excess materials, including excessive waste materials. More economical and ecologically friendly systems are needed.

SUMMARY

The present disclosure is directed to shipping container systems, substantially as shown in and/or described in connection with at least one of the FIGURES

DETAILED DESCRIPTION

Figure 1:
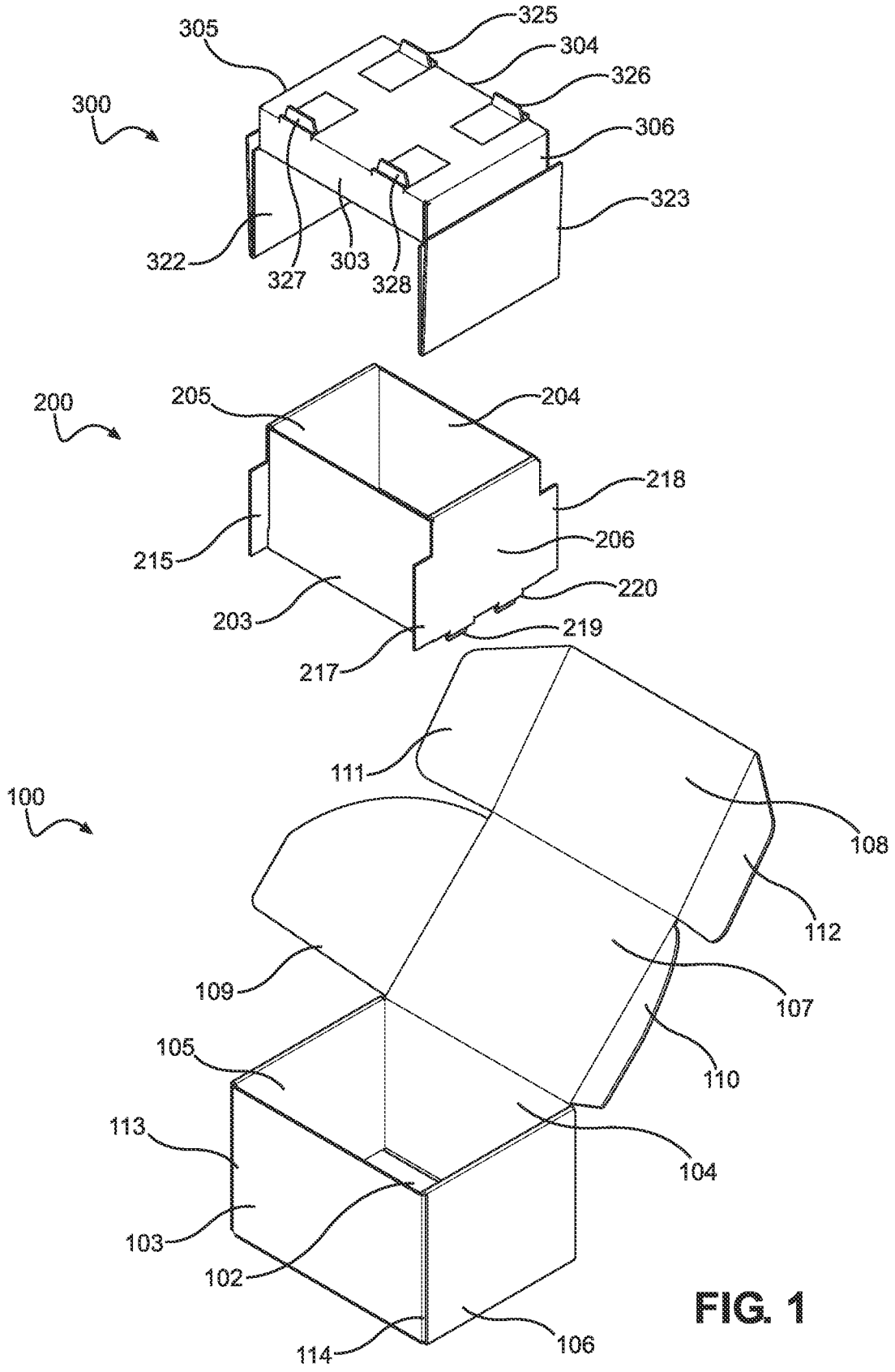
FIG. 1 shows an exploded view of the shipping container system, according to one embodiment of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 shows an exploded view for the shipping container system, according to one embodiment of the present disclosure. The shipping container system includes an outer container, a product compartment base, and a product compartment lid. The Outer Container is a container for shipping, storing, and displaying consumer products. The Outer Container generally includes an Outer Container base, one or more Outer Container sidewalls. The Outer Container may additionally include an Outer Container lid. In some embodiments, the Outer Container lid may be connected to one of the Outer Container sidewalls, such as hingedly connected to a top of one of the Outer Container sidewalls. In other embodiments, the Outer Container lid may be a separate Outer Container lid. The Outer Container may have an open configuration in which the Outer Container lid is configured to allow insertion or removal of a consumer product from inside the Outer Container. In some embodiments, the open configuration of the Outer Container may allow insertion or removal of the Product Compartment Base and Product Compartment Lid. When the Outer Container is in a closed configuration, the Outer Container lid is configured to complete and enclose the Outer Container, substantially covering an Outer Container opening formed by the terminal ends of the Outer Container sidewalls.

As shown in FIG. 1, the shipping container system includes Outer Container 100 having an Outer Container length, an Outer Container width, and an Outer Container height. Outer Container 100 includes Outer Container base 102 and four upstanding walls, Outer Container sidewalls 103 and 104, and Outer Container end walls 105 and 106, Outer Container lid 107, and Outer Container securing panel 108. The four upstanding walls extend from Outer Container base 102 to a terminal end at a top of each upstanding sidewall. The terminal ends of the upstanding sidewalls define an aperture that is open or substantially unobstructed when Outer Container 100 is in an open configuration. Outer Container lid 107 includes Outer Container securing flaps 109 and 110 extending from opposing ends of Outer Container lid 107. When Outer Container 100 is in the closed configuration, Outer Container securing flaps 109 and 110 extend downwardly from Outer Container lid 107 towards Outer Container base 102 inside the cavity of Outer Container 100. In the closed configuration, Outer Container lid 107 substantially covers the aperture defined by the terminal ends of the upstanding walls. In the closed configuration, Outer Container securing panel 108 extends from the edge of Outer Container lid 107 proximate to the terminal end of sidewall 103 towards Outer Container base 102 along the outside of sidewall 103. In some embodiments, Outer Container 100 further includes Outer Container retention flaps 111 and 112. In some embodiments, Outer Container retention flaps 111 and 112 may be inserted into Outer Container retention slots 113 and 114 to secure Outer Container 100 in the closed configuration.

As shown in FIG. 1, Outer Container 100 includes Product Compartment Base 200. Product Compartment Base 200 includes Product Compartment Base floor 202 (not visible) and four upstanding Product Compartment Base walls defining a Product Compartment Base cavity. In some embodiments, the Product Compartment Base cavity is a product retention chamber for receiving and storing a product after manufacture of the product, such as during processing, storage, shipping, and delivery of the product. The four upstanding walls include Product Compartment Base sidewalls 203 and 204, and Product Compartment Base end walls 205 and 206. In some embodiments, Product Compartment 200 may include Product Compartment retention tabs extending from end walls 205 and 206. As shown in FIG. 1, Product Compartment Base 200 includes Product Compartment retention tabs 215 and 216 (not visible) extending from Product Compartment end wall 205 and Product Compartment retention tabs 217 and 218 extending from Product Compartment end wall 206. Product Compartment retention tabs 215, 216, 217, and 218 may create and maintain a cushion gap between the walls of Outer Container 100 and the product retention chamber of Product Compartment Base 200 when Product Compartment Base 200 is installed in Outer Container 100.

In some embodiments, the width of each Product Compartment Base end wall and the associated Product Compartment retention tabs may be substantially the same as, or slightly less than, an inner width of Outer Container 100, allowing Product Compartment Base 200 to securely retain and cushion a product inserted into the product retention chamber of Product Compartment Base 200. In some embodiments, each Product Compartment retention tabs 215, 216, 217, and 218 may have a Product Compartment retention tab height that is less than a Product Compartment height of the associated Product Compartment end walls. The Product Compartment retention tab height being less than the Product Compartment height of the associated Product Compartment end walls may accommodate installation of a Product Compartment lid over Product Compartment Base 200 when Product Compartment Base 200 is installed in Outer Container 100.

As shown in FIG. 1, Product Compartment Base 200 includes Product Compartment support tabs 219 and 220, extending from a lower end of Product Compartment end wall 206, and Product Compartment support tabs 221 and 222 (neither visible) extending from a lower end of Product Compartment end wall 205. The Product Compartment support tabs may support and maintain a cushion gap between Outer Container base 102 of Outer Container 100 and the product retention chamber of Product Compartment Base 200 when Product Compartment Base 200 is installed in Outer Container 100.

As shown in FIG. 1, the shipping container system includes Product Compartment Lid 300. Product Compartment Lid 300 includes Product Compartment Lid sidewalls 303 and 304, and Product Compartment Lid end walls 305 and 306. In some embodiments, the Product Compartment Lid sidewalls and Product Compartment Lid end walls define a Product Compartment Lid cavity configured to receive a top end of Product Compartment Base 200 when Product Compartment Lid 300 is installed over Product Compartment Base 200 in Outer Container 100.

In some embodiments, the Product Compartment length of the Product Compartment sidewalls of Product Compartment Base 200 may be less than an inner length of Outer Container 100, allowing Product Compartment Base 200 to be inserted into the product retention chamber of Product Compartment Base 200 and accommodate suspension elements of Product Compartment lid 300 when Product Compartment Base 200 and Product Compartment lid 300 are installed in Outer Container 100. In some embodiments, Product Compartment Lid end walls 305 and 306 extend to form Product Compartment Lid suspension units 322 and 323, respectively. As shown in FIG. 1, Product Compartment Lid suspension unit 322 extends from Product Compartment Lid end wall 305 towards Outer Container base 102, and Product Compartment Lid suspension unit 323 extends from Product Compartment Lid end wall 306 towards Outer Container base 102 when Product Compartment Lid 300 is installed in Outer Container 100. Each Product Compartment Lid suspension unit includes an accordion fold and extends back towards the terminal end of the upstanding sidewalls of Outer Container 100. The L may be separated components. In other embodiments, the Product Compartment Base may be attached to the Product Compartment Lid.

In some embodiments, Product Compartment Lid 300 may include Product Compartment Lid space tabs 325, 326, 327, and 328 extending above Product Compartment Lid 300, where above means the direction towards the inside of Outer Container lid 107 when Product Compartment Lid 300 is installed over Product Compartment Base 200 in Outer Container 100 and when Outer Container 100 is in a closed configuration.

In some embodiments, the length, width, and height of Product Compartment Base 200 and Product Compartment Lid 300, when combined, are approximately the same dimensions as the inner dimensions of Outer Container 100 in the closed configuration. The retention tabs, support tabs, space tabs, and suspension elements of Product Compartment Base 200 and Product Compartment Lid 300 provide a cushion gap on all sides of the product compartment when Product Compartment Base 200 and Product Compartment Lid 300 are installed into Outer Container 100. The cushion gap may allow for safe and secure transportation and storage of a product that is inserted into the shipping container system.

Figure 2:
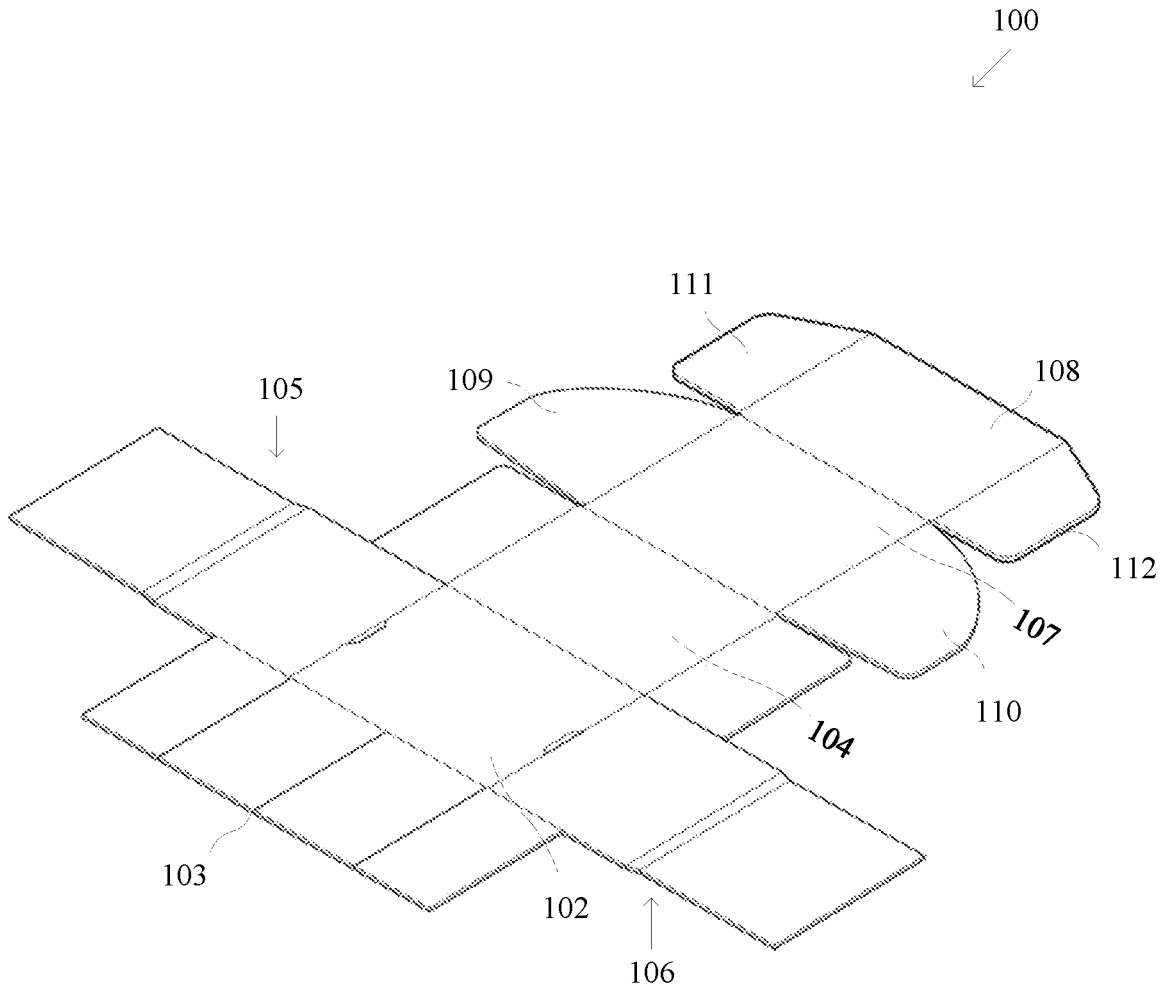
FIG. 2 shows a diagram of a shipping container system blank for folding the outer container of the shipping container system of FIG. 1, according to an embodiment of the present disclosure.

FIG. 2 shows a diagram of a shipping container system blank for folding the outer container of the shipping container system of FIG. 1, according to an embodiment of the present disclosure. FIG. 2 shows Outer Container base 102, Outer Container sidewalls 103 and 104, Outer Container end walls 105 and 106, Outer Container lid 107, Outer Container securing panel 108, Outer Container securing flaps 109 and 110, and Outer Container retention flaps 111 and 112.

Figure 3:
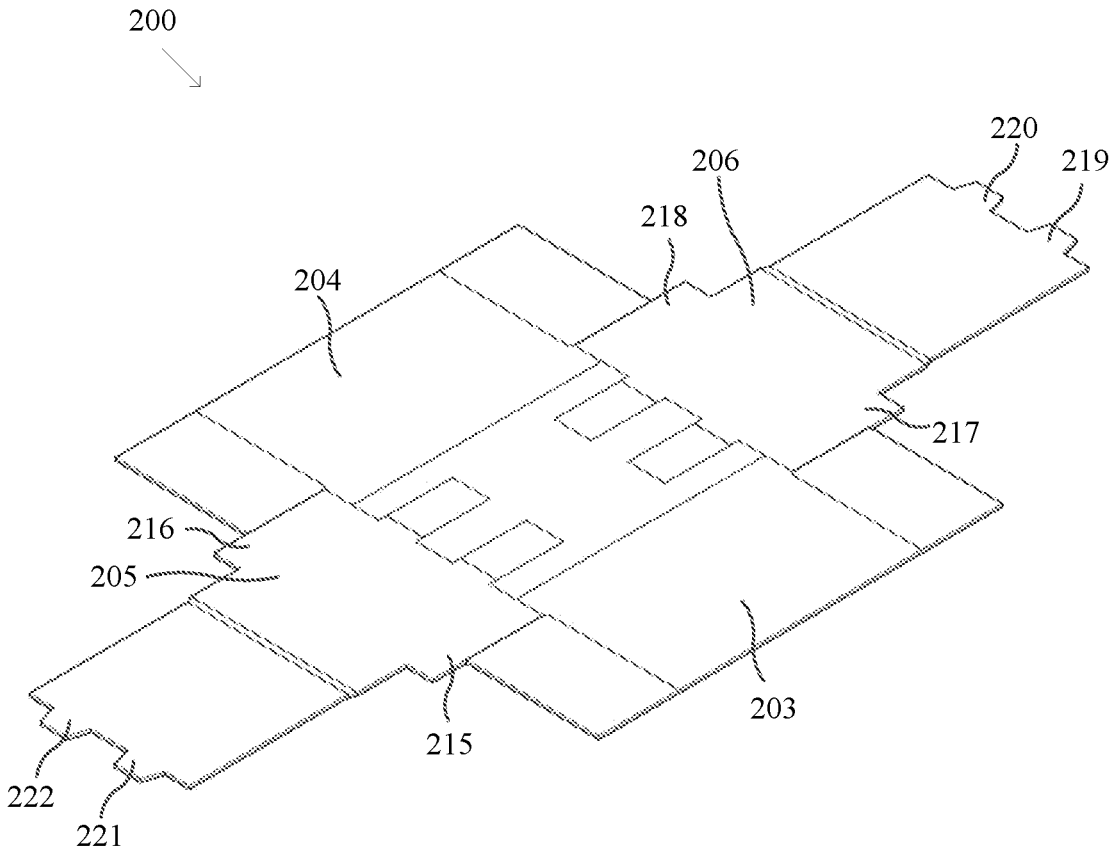
FIG. 3 shows a diagram of a shipping container system blank for folding the inner compartment base of the shipping container system of FIG. 1, according to an embodiment of the present disclosure.

FIG. 3 shows a diagram of a shipping container system blank for folding the inner compartment base of the shipping container system of FIG. 1, according to an embodiment of the present disclosure. FIG. 3 shows Product Compartment Base 200, Product Compartment Base sidewalls 203 and 204, Product Compartment Base end walls 205 and 206, Product Compartment retention tabs 215 and 216, Product Compartment retention tabs 217 and 218, Product Compartment support tabs 219 and 220, and Product Compartment support tabs 221 and 222.

Figure 4:
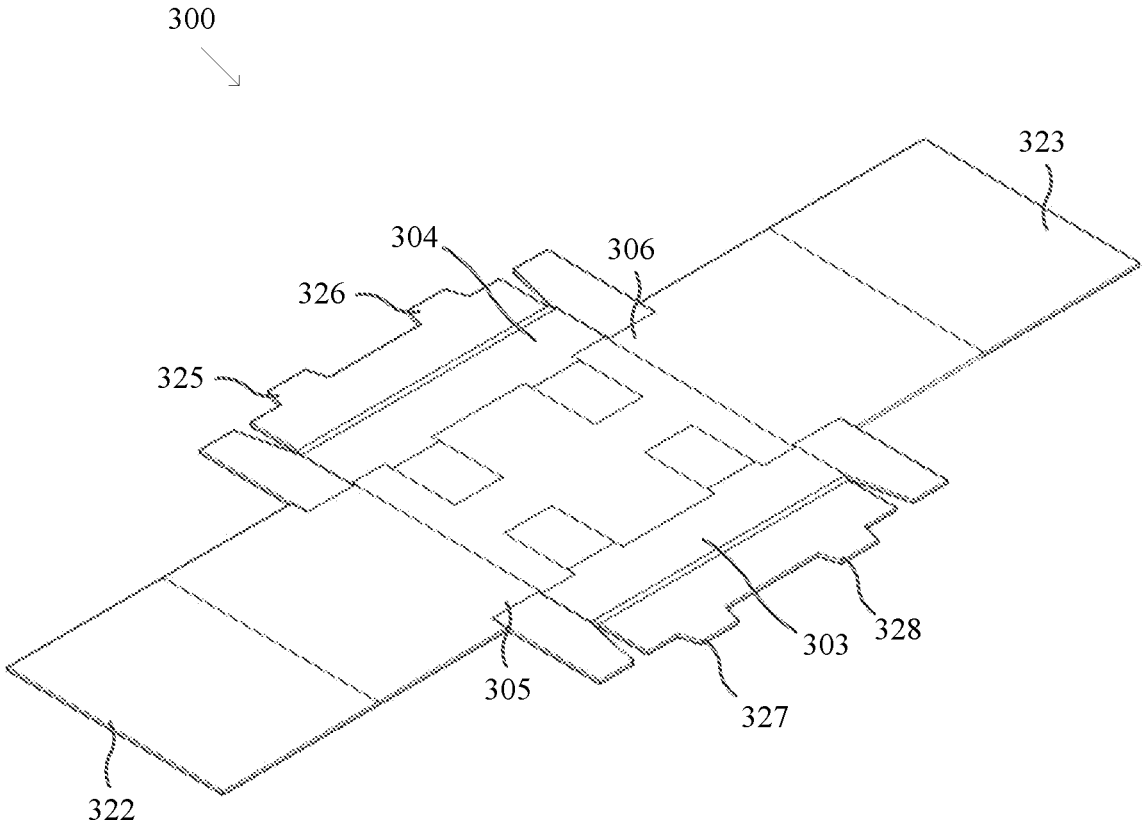
FIG. 4 shows a diagram of a shipping container system blank for folding the inner compartment lid of the shipping container system of FIG. 1, according to an embodiment of the present disclosure.

FIG. 4 shows a diagram of a shipping container system blank for folding the inner compartment lid of the shipping container system of FIG. 1, according to an embodiment of the present disclosure. FIG. 4 shows Product Compartment Lid 300, Product Compartment Lid sidewalls 303 and 304, Product Compartment Lid end walls 305 and 306, Product Compartment Lid suspension units 322 and 323, and Product Compartment Lid space tabs 325, 326, 327, and 328.

Figure 5:
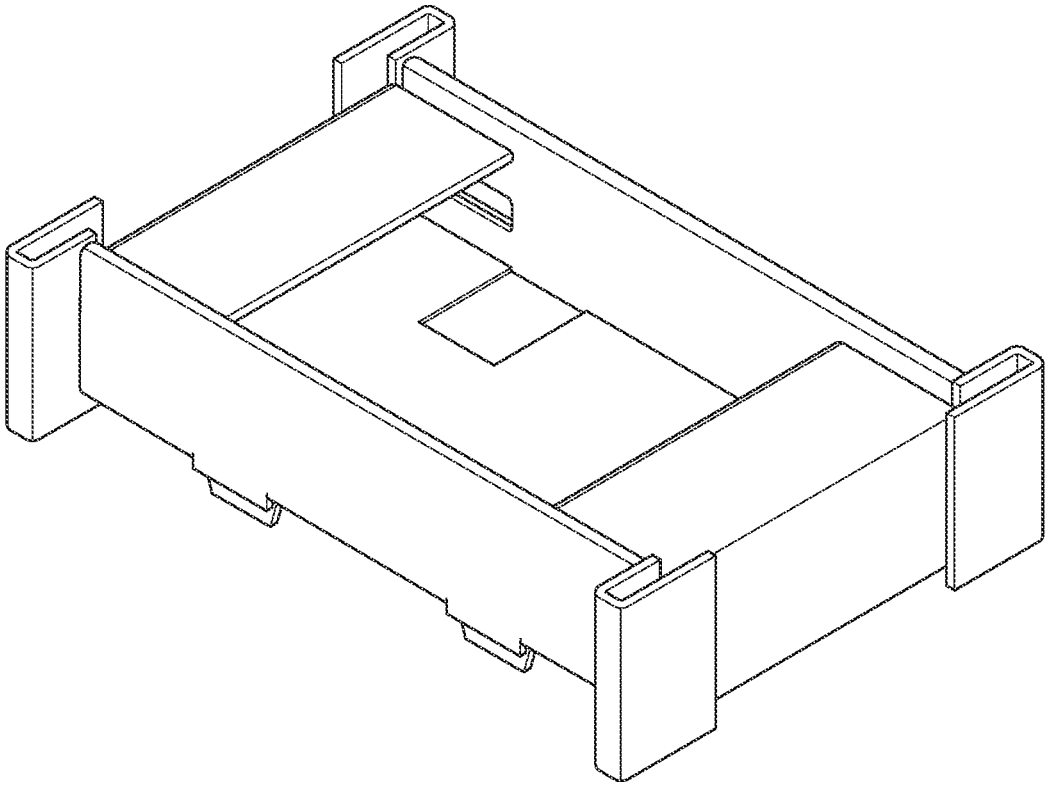
FIG. 5 shows a diagram of a shipping container system including an electronic device shipping insert, according to an embodiment of the present disclosure.

FIG. 5 shows a shipping container system including an electronic device shipping insert, according to an embodiment of the present disclosure. Electronic device shipping insert 500 includes a product compartment with a base, four upstanding sidewalls, device retention shelves on each end of a length of electronic device shipping insert 500, and suspension elements extending from each end of electronic device shipping insert 500. The four upstanding sidewalls of electronic device shipping insert 500 include a pair of opposing end walls that fold up from the base of electronic device shipping insert 500. Each end wall continues with a fold extending the lower panel of a shelf towards the middle of electronic device shipping insert 500. The lower panel of the shelf terminates and the panel folds back over itself to form the upper panel of the shelf. The panel continues to fold and create the suspension unit extending from either end of electronic device shipping insert 500 with vertical folding cushion gaps formed by folding suspension tabs to create a cushion gap, as shown in FIG. 5.

Figure 6:
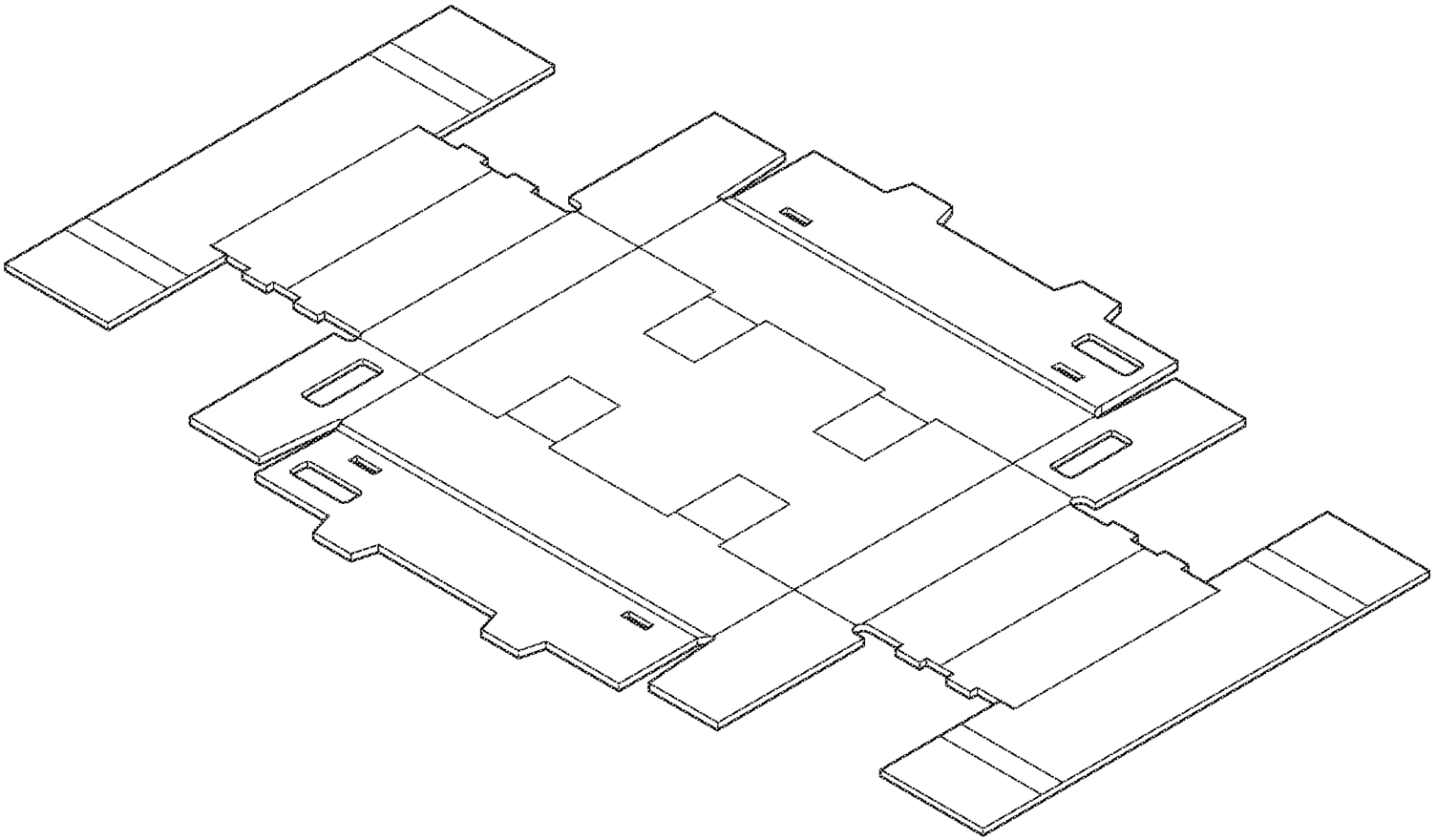
FIG. 6 shows a diagram of a blank from which the EDSI of FIG. 5 is folded, according to an embodiment of the present disclosure.

FIG. 6 shows a folded blank from which the electronic device shipping insert of FIG. 5 is folded, according to an embodiment of the present disclosure.

Figure 7:
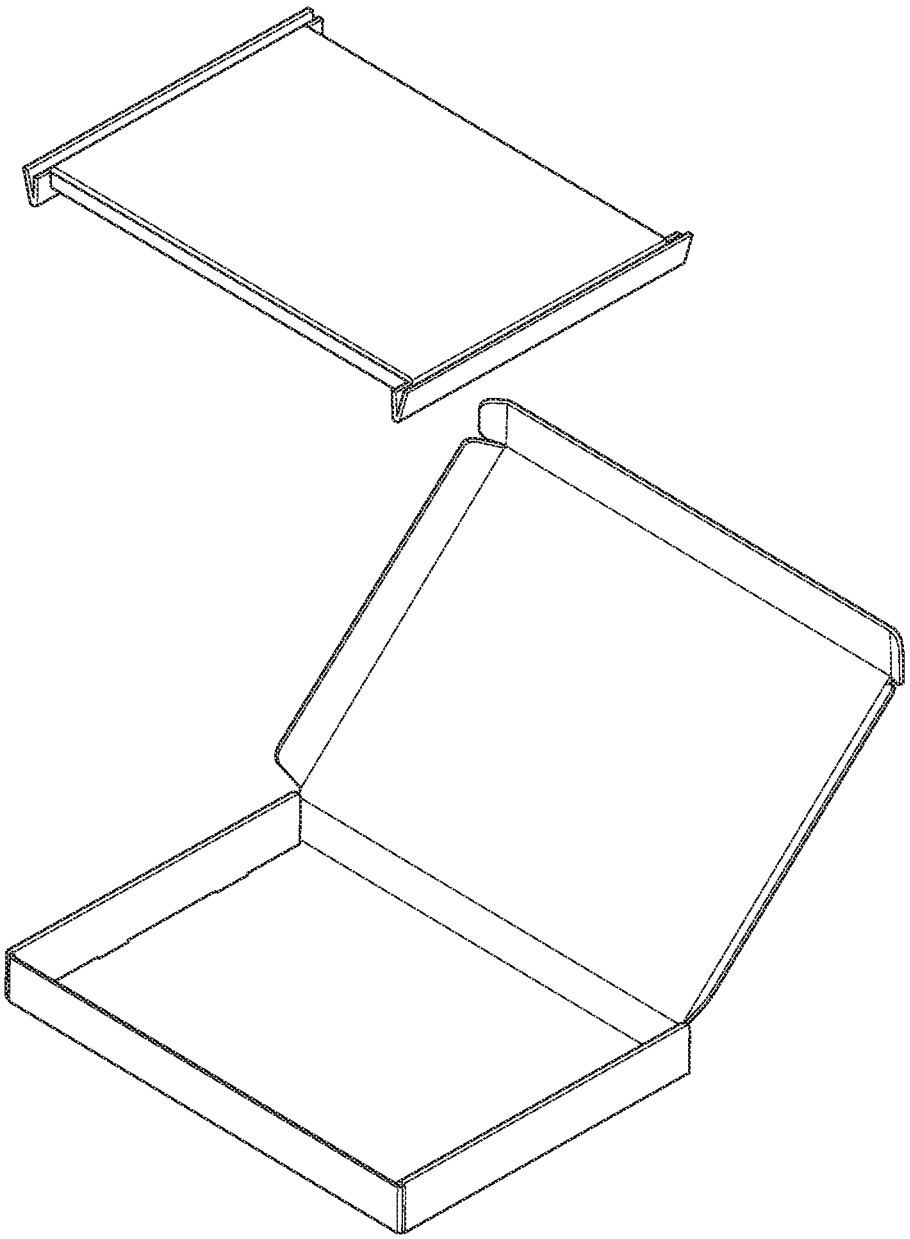
FIG. 7 shows a shipping container system for shipping laptop and tablet computers, according to an embodiment of the present disclosure.

FIG. 7 shows a shipping container system for shipping laptop and tablet computers, according to an embodiment of the present disclosure.

Figure 8:
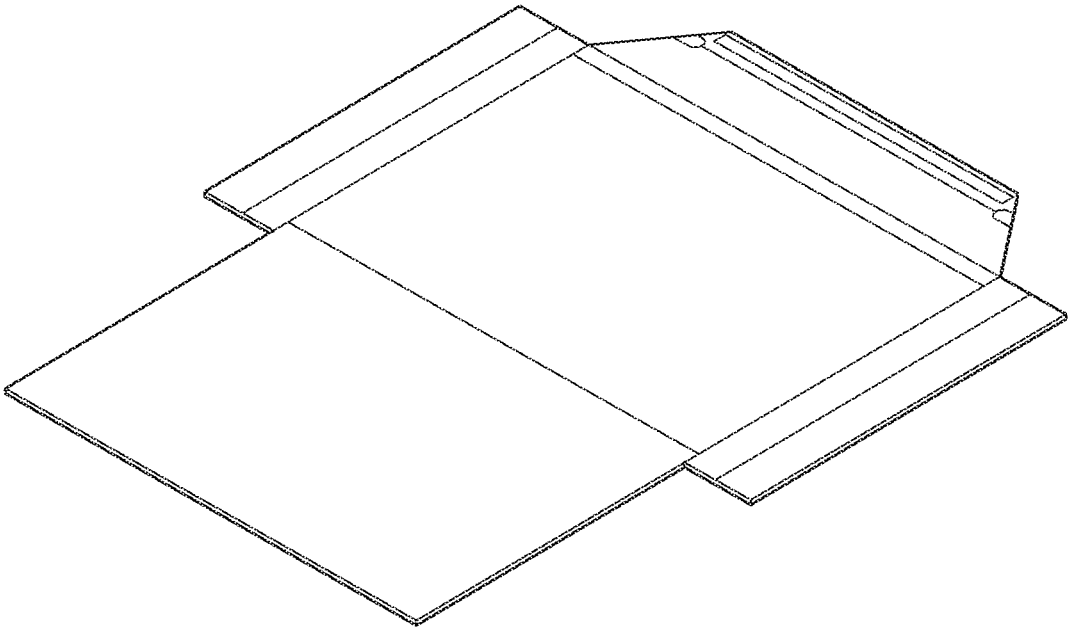
FIG. 8 shows a diagram of a blank from which the shipping container of FIG. 7 is folded, according to an embodiment of the present disclosure.

FIG. 8 shows a diagram of a blank from which the shipping container of FIG. 7 is folded, according to an embodiment of the present disclosure.

Figure 9:
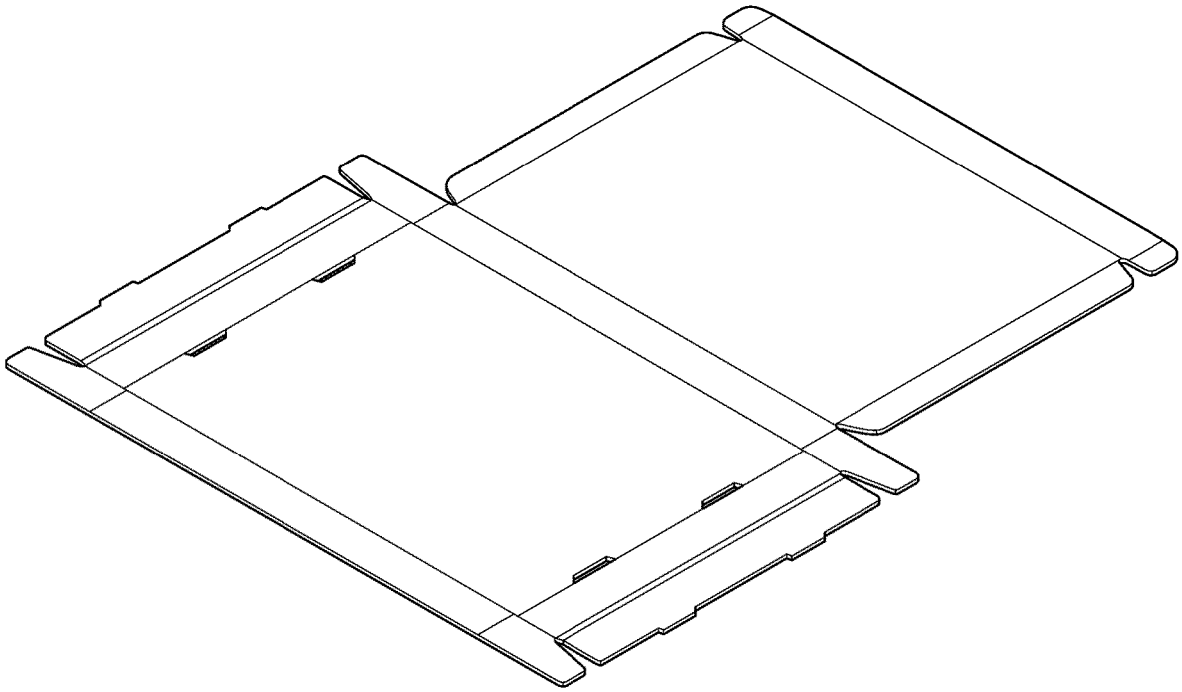
FIG. 9 shows a diagram of another blank from which the shipping container of FIG. 7 is folded, according to an embodiment of the present disclosure.

FIG. 9 shows a diagram of another blank from which the shipping container of FIG. 7 is folded, according to an embodiment of the present disclosure.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A shipping container system comprising:

an outer container; and a product compartment inside the outer container, wherein the product compartment comprises a product compartment base and a product compartment lid, and wherein the product compartment base comprises a plurality of retention tabs maintaining a cushion gap between the product compartment and sidewalls of the outer container, a plurality of support tabs maintaining a cushion gap between the product compartment and a base of the outer container, and wherein the product compartment lid includes a pair of suspension units each extending downward from the product compartment lid and comprising an accordion fold maintaining a cushion gap between the product compartment and each end of a pair of opposing ends of the outer container, and a plurality of space tabs maintaining a cushion gap between the product compartment and a lid of the outer container, wherein the cushion gaps are maintained between the product compartment and the outer container when the outer container is in a closed configuration.

2. The shipping container system of claim 1, wherein the product compartment base is installed in the outer container and the product compartment lid is installed over the product compartment base, forming an enclosed product compartment surrounded by a cushion gap on all sides when the outer container is in a closed configuration.

3. The shipping container system of claim 1, wherein the product compartment comprises a product compartment floor, four upstanding walls and a lid when the product compartment lid is installed on the product compartment base.

4. The shipping container system of claim 1, wherein the plurality of retention tabs extend from each side of a lower end of a product compartment end wall and have a product compartment retention tab height that is less than a height of the product compartment end wall.

5. The shipping container system of claim 1, wherein the product compartment comprises a product compartment floor, four upstanding walls and the product compartment lid includes a plurality of side walls and a plurality of end walls defining a product compartment lid cavity, wherein the product compartment lid cavity receives the upper ends of the product compartment upstanding walls.

6. The shipping container system of claim 1, wherein the outer container includes an outer container base, one or more outer container sidewalls and an outer container lid.

7. The shipping container system of claim 6, wherein the outer container lid is hingedly connected to a top of one of the Outer Container sidewalls.

* * * * *